US012760648B2

(12) United States Patent
Zhang et al.

(10) Patent No.: US 12,760,648 B2
(45) Date of Patent: Oct. 13, 2026

(54) FABRICATED UNDERGROUND ENGINEERING BUFFER LAYER SUPPORT STRUCTURE

(71) Applicants: TAIZHOU UNIVERSITY, Taizhou (CN); INSTITUTE OF ROCK AND SOIL MECHANICS, CHINESE ACADEMY OF SCIENCES, Wuhan (CN)

(72) Inventors: Chaoxuan Zhang, Taizhou (CN); Xianjun Tan, Wuhan (CN); Weizhong Chen, Wuhan (CN); Rui Mao, Taizhou (CN); Changkun Qin, Wuhan (CN); Hongming Tian, Wuhan (CN); Zhiyou Deng, Taizhou (CN); Yongzhou Chen, Taizhou (CN)

(73) Assignees: TAIZHOU UNIVERSITY, Taizhou (CN); INSTITUTE OF ROCK AND SOIL MECHANICS, CHINESE ACADEMY OF SCIENCES, Wuhan (CN)

( * ) Notice: Subject to any disclaimer, the term of this patent is extended or adjusted under 35 U.S.C. 154(b) by 119 days.

(21) Appl. No.: 18/812,528

(22) Filed: Aug. 22, 2024

(65) Prior Publication Data

US 2026/0055704 A1 Feb. 26, 2026

(51) Int. Cl.
*E21D 11/00* (2006.01)

(52) U.S. Cl.
CPC ..... *E21D 11/00* (2013.01)

(58) Field of Classification Search
CPC ..... E21D 11/00; E21D 11/10; E21D 11/18; E21D 11/15; E21D 11/006; E21D 5/01; E21D 5/11; E21D 11/05
See application file for complete search history.

(56) References Cited

U.S. PATENT DOCUMENTS 6,193,439 B1 * 2/2001 Wolfseher ..... E21D 11/105 405/150.2
11,598,210 B1 * 3/2023 Zheng ..... E21D 11/05
(Continued)

FOREIGN PATENT DOCUMENTS

CN 111186459 * 1/2021
CN 112832812 * 5/2021
(Continued)

*Primary Examiner* — Carib A Oquendo
(74) *Attorney, Agent, or Firm* — Oliff PLC

(57) ABSTRACT

The present invention provides a fabricated underground engineering buffer layer support structure, comprising first structural plate, having a first surface and a second surface, and being connected to an initial support layer through the first surface; second structural plate, having a third surface and a fourth surface, and being connected to a secondary lining layer through the fourth surface; flexible energy dissipation component, being arranged in first buffering energy dissipation space formed between the second surface and the third surface and filled with first porous lightweight material that is arranged on a periphery of a wave-shaped plastic-material first plate in a wrapping manner. The flexible energy dissipation component is arranged at an arch ring, an inverted arch, and an arch foot with single layer or multiple layers, and a layer thickness of the flexible energy dissipation component and strength and density of the porous lightweight material can be designed non-uniformly.

10 Claims, 2 Drawing Sheets

(56) References Cited

U.S. PATENT DOCUMENTS

| | | | | |
|---|---|---|---|---|
| 2011/0250012 | A1* | 10/2011 | Paschkowski | E01D 19/083 428/323 |
| 2023/0258085 | A1* | 8/2023 | Wang | E21D 11/107 405/150.1 |
| 2025/0129886 | A1* | 4/2025 | Liu | F17C 1/007 |

FOREIGN PATENT DOCUMENTS

| | | | |
|---|---|---|---|
| CN | 114109439 | * | 3/2022 |
| CN | 115217488 | * | 10/2022 |
| CN | 116624165 | * | 8/2023 |
| CN | 117967347 | * | 5/2024 |
| DE | 4102266 | * | 8/1992 |

* cited by examiner

FABRICATED UNDERGROUND ENGINEERING BUFFER LAYER SUPPORT STRUCTURE

TECHNICAL FIELD

The present invention belongs to the technical field of underground engineering, and particularly relates to a fabricated underground engineering buffer layer support structure.

BACKGROUND

In underground engineering, due to the low strength and significant rheological mechanics properties of soft and weak rock masses, an initial support structure in the stage of excavation and a secondary lining in the service period undergo deformation and failure caused by excessive surrounding rock deformation pressure. The buffer layer support structure, as an interlayer support structure, absorbs the harmful deformation of the surrounding rock and dissipates some of the deformation energy of the surrounding rock through constant-resistance deformation in the compression process of the volume of the buffer layer, so that the load on the support structure can be alleviated. Especially under the working condition of a biased formation, this can make the support structure more evenly stressed. The existing buffer layer support mainly has the following problems: (1) For filling type support structures such as foam concrete, ceramsite light soil and other materials, they are cast-in-place construction and thus needs a long curing time, and great labor is needed in the template disassembly and assembly process. Polyurethane and polyethylene foam is convenient to pave but non-fireproof. As a result, it is not suitable for special underground engineering such as mine engineering. (2) For non-filling type support structures, such as arranging thin-walled circular steel pipes as energy absorption elements, due to spaced installation, stress points for achieving a constant-resistance support are discontinuous. Although they can absorb the deformation of the surrounding rock to a certain extent, it is easy to cause an overlarge local stress in the support structure, and interlayer gaps and pavement gaps caused by the discrete points are not conducive to the implementation of an underground engineering waterproof structure and are prone to damage a waterproof layer.

It can be seen that how to provide a buffer layer support structure that can dissolve the deformation pressure of underground engineering rock masses, is convenient to install and high applicable, and has a little impact on other construction processes is a technical problem urgently to be solved by technicians in the art.

SUMMARY

The present invention provides a fabricated underground engineering buffer layer support structure to solve at least the above-mentioned technical problems.

In order to solve the above-mentioned problems, a first aspect of the present invention provides a fabricated underground engineering buffer layer support structure. The buffer layer support structure can be paved between an initial support and a surrounding rock as a buffer layer as needed, or between the initial support and a secondary lining as the buffer layer as needed, or can be arranged in a full cross-section or separately arranged at an arch ring, an inverted arch, and an arch foot as needed. The support structure includes: a first structural plate including a first surface and a second surface, wherein the first structural plate is connected to an initial support layer through the first surface; a second structural plate including a third surface and a fourth surface, wherein the second structural plate is connected to a secondary lining layer through the fourth surface, and a first buffering energy dissipation space is formed between the first surface and the fourth surface; and, a flexible energy dissipation component arranged in the first buffering energy dissipation space, wherein the flexible energy dissipation component includes a first plate as a skeleton, and a first porous lightweight material filled in the first buffering energy dissipation space and arranged on a periphery of the first plate in a wrapping manner, and the first plate is of a wave shape; an outer wall of the first porous lightweight material is provided with first buffering energy absorption channels communicated with an interior of the first porous lightweight material, and when the first porous lightweight material is squeezed, gas inside the first porous lightweight material is squeezed and released through the first buffering energy absorption channels; and, the first structural plate, the flexible energy dissipation component, and the second structural plate form an integrated first structural body.

In the first aspect, the buffering energy absorption component further includes: a second plate arranged parallel and opposite to the first plate; the second plate is of a wave shape, a second buffering energy dissipation space is formed between the second plate and the first plate, and the second buffering energy dissipation space is filled with a second porous lightweight material; an outer wall of the second porous lightweight material is provided with second buffering energy absorption channels communicated with an interior of the second porous lightweight material, and when the second porous lightweight material is squeezed, gas inside the second porous lightweight material is squeezed and released through the second buffering energy absorption channels; and, the first plate, the porous lightweight material, and the second plate form an integrated second structural body.

In the first aspect, the first plate and the second plate both are of a sine wave shape, a wave peak portion of the sine wave shaped first plate is correspondingly connected to the second surface of the first structural plate on a corresponding side, and a wave peak portion of the sine wave shaped second plate is correspondingly connected to the fourth surface of the second structural plate on a corresponding side.

In the first aspect, the wave peak portion of the first plate is welded to the second surface of the first structural plate on the corresponding side, and the wave peak portion of the second plate is welded to the fourth surface of the second structural plate on the corresponding side; and/or, the wave peak portion of the first plate is connected to the second surface of the first structural plate on the corresponding side through a first anchor rod, and the wave peak portion of the second plate is connected to the fourth surface of the second structural plate on the corresponding side through a second anchor rod.

In the first aspect, the flexible energy dissipation component further includes: a third plate, and a fourth plate arranged horizontally opposed to the third plate, wherein the third plate and the fourth plate are horizontal plates, a third buffering energy dissipation space is formed between the third plate and the fourth plate, and the space between the third plate and the fourth plate is filled with a third porous lightweight material, an outer wall of the third porous lightweight material is provided with third buffering energy absorption channels communicated with an interior of the third porous lightweight material, and when the third porous lightweight material is squeezed, gas inside the third buffering energy absorption channels is released; and, the third plate, the third porous lightweight material, and the fourth plate form an integrated third structural body.

In the first aspect, a thickness of the first structural body is 50 mm to 250 mm.

In the first aspect, the porous lightweight material arranged between the first plate and the second plate in a filling manner has a filling density of 250 kg/m$^3$ to 700 kg/m$^3$.

In the first aspect, the porous lightweight material includes one of the following materials: foam concrete, ceramsite microsphere mixed lightweight soil, a porous slag material, polyurethane foam, etc.

In the first aspect, the flexible energy dissipation component may be provided with multiple layers; a strength and a density of the porous lightweight material filled inside the flexible energy dissipation component of the buffer layer support structure being arranged at different arrangement positions are able to be designed non-uniformly; and, when the flexible energy dissipation component is designed with multiple layers, the porous lightweight material filled inside the flexible energy dissipation component of different layers is designed with equal density and strength, or designed to have gradients in density and intensity.

In the first aspect, a plurality of pouring holes is arranged in the first plate and the second structural body in a penetrating manner.

Beneficial effects: the present invention proposes a fabricated underground engineering buffer layer support structure; by arranging the flexible energy dissipation component between the first structural plate and the second structural plate, when a soft rock tunnel support structure is subjected to squeezing stress, the flexible energy dissipation component can achieve the function of buffering energy dissipation. During arranging, the first surface of the first structural plate is connected to the initial support layer, and the second surface of the second structural plate is connected to the secondary lining layer, so that the first buffering energy dissipation space is formed between the second surface of the first structural plate and the fourth surface of the second structural plate. Then, the first plate and the first porous lightweight material arranged on the periphery of the first plate in the wrapping manner are arranged in the first buffering space, the first plate is in the wave shape and the first buffering energy absorption channels is inside the first porous lightweight material. When the first porous lightweight material is subjected to squeezing stress, the shape of the first buffering energy absorption channels will also deform, so as to squeeze and release the gas inside the first porous lightweight material through the first buffering energy absorption channels. When the first buffering energy absorption channels deform, it will also drive the first plate arranged inside the first porous lightweight material to correspondingly deform, thereby achieving the technical effect of offsetting squeezing stress. In addition, since the porous lightweight materials have the inherent characteristics of freeze protection, heat preservation, and vibration reduction, the present invention is helpful to realize the integrated design aiming at solving large tunnel extrusion deformation, freeze damage, and seismic hazard.

BRIEF DESCRIPTION OF THE DRAWINGS

To describe the technical solutions in embodiments of the description or the prior art more clearly, the following briefly describes the accompanying drawings required for describing the embodiments. Apparently, the accompanying drawings in the following description show only some embodiments of the present invention, and a person of ordinary skill in the art may still derive other accompanying drawings from the accompanying drawings without creative efforts.

LIST OF REFERENCE NUMERALS

1—initial support layer;

2—flexible energy dissipation component; 201—first structural plate; 202—second structural plate; 203—first plate; 204—first porous lightweight material; 205—second plate; 206—second porous lightweight material; and

3—secondary lining layer.

DETAILED DESCRIPTION

The technical solutions in the present invention will be clearly and completely described below with reference to the accompanying drawings. Apparently, the described embodiments are merely some rather than all of the embodiments of the present invention. All other embodiments obtained by persons of ordinary skills based on the embodiments in the present invention fall within the protection scope of the present invention.

Meanwhile, in embodiments of this description, when a component is referred to as "being fixed to" another component, the component may be directly on the other component, or an intermediate component may be present. When a component is considered to be "connected to" another component, the component may be directly connected to the other component, or an intermediate component may be present. When a component is considered to be "arranged on" another component, the component may be directly arranged on the other component, or an intermediate component may be present. The terms "vertical", "horizontal", "left", "right", and similar expressions used in the embodiments of this description are only for the purpose of illustration, but not intended to limit the present invention.

Embodiment I

Figure 1:
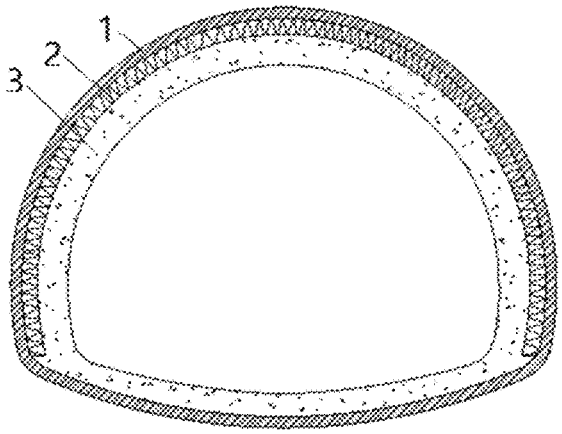
FIG. 1 is a structural diagram I of a fabricated underground engineering buffer layer support structure in Embodiment I of the present invention.
Figure 2:
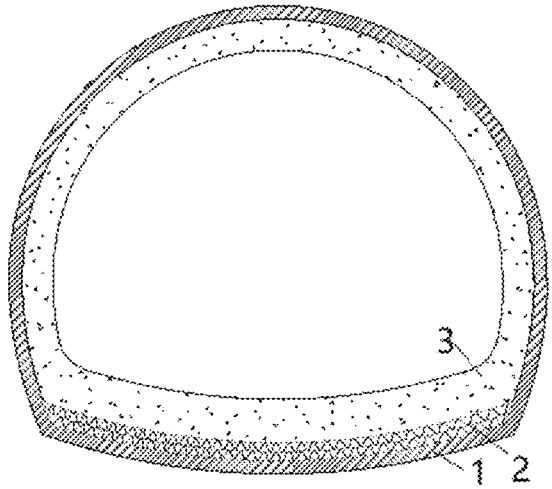
FIG. 2 is a structural diagram II of the fabricated underground engineering buffer layer support structure in Embodiment I of the present invention.
Figure 3:
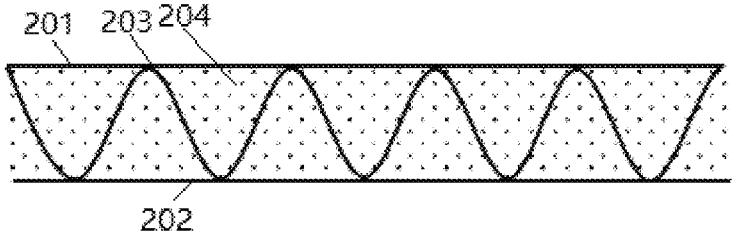
FIG. 3 is a structural diagram of a flexible energy dissipation component in Embodiment I of the present invention.
Figure 4:
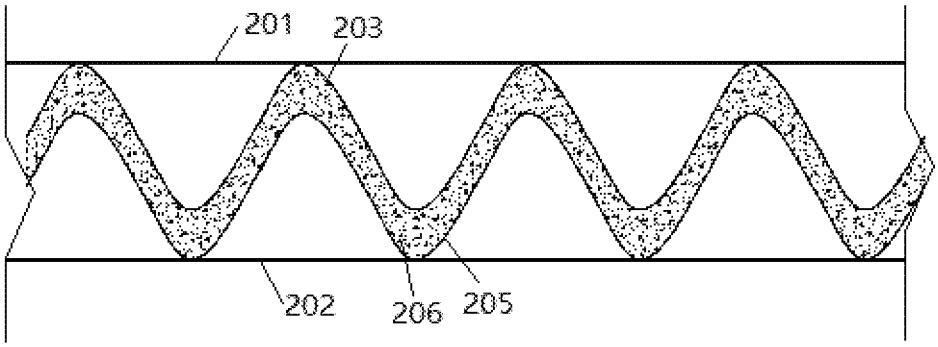
FIG. 4 is a structural diagram III of the fabricated underground engineering buffer layer support structure in Embodiment I of the present invention.
Figure 5:
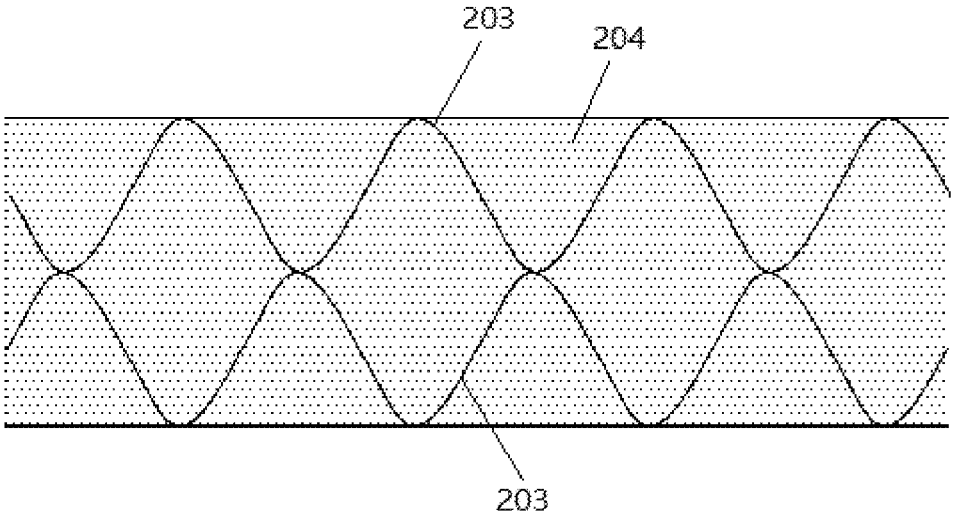
FIG. 5 is a structural diagram IV of the fabricated underground engineering buffer layer support structure in Embodiment I of the present invention.

As shown in FIGS. 1 to 4, the present embodiment provides a fabricated underground engineering buffer layer support structure. The support structure is arranged between an initial support layer 1 and a secondary lining layer 3 of a tunnel. The support structure includes a first structural plate 201, a second structural plate 202, and a flexible energy dissipation component 2 arranged in a first buffering energy dissipation space.

The first structural plate 201 includes a first surface and a second surface. The first structural plate 201 is connected to the initial support layer 1 through the first surface. The second structural plate 202 includes a third surface and a fourth surface. The second structural plate 202 is connected to the secondary lining layer 3 through the fourth surface. The first buffering energy dissipation space is formed between the second surface and the third surface. The flexible energy dissipation component 2 includes a first plate 203 prepared and formed by a plastic material, and a first porous lightweight material 204 filled in the first buffering energy dissipation space and arranged on a periphery of the first plate 203 in a wrapping manner. The first plate 203 is of a wave shape. An outer wall of the first porous lightweight material 204 is provided with first buffering energy absorption channels communicated with an interior of the first porous lightweight material 204. When the first porous lightweight material 204 is squeezed, gas inside the first porous lightweight material 204 is squeezed and released through the first buffering energy absorption channels. The first structural plate 201, the flexible energy dissipation component 2, and the second structural plate 202 form an integrated first structural body.

Specifically, the Embodiment I of the present invention proposes a fabricated underground engineering buffer layer support structure. By arranging the flexible energy dissipation component 2 between the first structural plate 201 and the second structural plate 202, when a soft rock tunnel support structure is subjected to squeezing stress, the flexible energy dissipation component 2 can achieve the function of buffering energy dissipation. During arranging, the first surface of the first structural plate 201 is connected to the initial support layer 1, and the second surface of the second structural plate 202 is connected to the secondary lining layer 3, so that the first buffering energy dissipation space is formed between the second surface of the first structural plate 201 and the fourth surface of the second structural plate 202. Then, the first plate 203 and the first porous lightweight material 204 arranged on the periphery of the first plate 203 in the wrapping manner are arranged in the first buffering space, the first plate 203 is in the wave shape and the first buffering energy absorption channels are inside the first porous lightweight material 204. When the first porous lightweight material 204 is subjected to squeezing stress, the shape of the first buffering energy absorption channels will also deform, so as to squeeze and release the gas inside the first porous lightweight material 204 through the first buffering energy absorption channels. When the first buffering energy absorption channels deform, it will also drive the first plate 203 arranged inside the first porous lightweight material 204 to correspondingly deform, thereby achieving the technical effect of offsetting external squeezing stress.

It needs to be noted that the first plate 203, the first porous lightweight material 204, and the second plate 205 may be applicable to a buffer layer support between the initial support layer 1 and the secondary lining layer 3. Paving is convenient, and a smooth contour is formed without any protrusions after installation, with a little impact on the paving of a waterproof layer. Moreover, materials of the first plate and the second plate are preferably thin sheet iron, and the material has good thermal conductivity. The porous lightweight material can play a good role in thermal insulation.

In some possible implementation modes, the buffering energy absorption component further includes: a second plate 205 arranged parallel and opposite to the first plate 203. The second plate 205 is of a wave shape. A second buffering energy dissipation space is formed between the second plate 205 and the first plate 203. The second buffering energy dissipation space is filled with a second porous lightweight material 206. An outer wall of the second porous lightweight material 206 is provided with second buffering energy absorption channels communicated with an interior of the second porous lightweight material 206. When the second porous lightweight material 206 is squeezed, gas inside the second porous lightweight material 206 is squeezed and released through the second buffering energy absorption channels. The first plate 203, the first porous lightweight material 204, and the second plate 205 form an integrated second structural body.

This is to enhance the structural stability of the buffering energy absorption component itself. The second plate 205 arranged parallel and opposite to the first plate 203 is arranged, both of which are in well-matched wave shapes. The second buffering energy dissipation space is formed between the second plate 205 and the first plate 203, and is filled with a porous lightweight material. An outer wall of the second porous lightweight material 206 is provided with second buffering energy absorption channels communicated with an interior of the second porous lightweight material 206. When the second porous lightweight material 206 is squeezed, gas inside the second porous lightweight material 206 is squeezed and released through the second buffering energy absorption channels. The first plate 203, the second porous lightweight material 206, and the second plate 205 form an integrated second structural body. Pouring holes for pouring are formed in an outer side wall of the second structural body, and the porous lightweight material is poured through the pouring holes. The second porous lightweight material 206 may be porous lightweight concrete.

In some possible implementation modes, shapes of the first plate 203 and the second plate 205 both are of a sine wave shape. A wave peak portion of the sine wave shaped first plate 203 is correspondingly connected to the second surface of the first structural plate 201 on a corresponding side. A wave peak portion of the sine wave shaped second plate 205 is correspondingly connected to the fourth surface of the second structural plate 202 on a corresponding side.

This is because the sine wave shape has a wave peak and a wave valley of standardized sizes, which makes the structural performance thereof stable, so that the wave peak portion of the first plate 203 is correspondingly connected to the second surface of the first structural plate 201 on the corresponding side, and the wave peak portion of the second plate 205 is correspondingly connected to the fourth surface of the second structural plate 202 on the corresponding side, thereby forming a stable integrated structure. Further, the present embodiment proposes a specific implementation mode for a connection mode between the first plate 203 and the first structural plate 201, as well as between the second plate 205 and the second structural plate 202. The implementation mode is as follows: the wave peak portion of the first plate 203 is welded to the second surface of the first structural plate 201 on the corresponding side, and the wave peak portion of the second plate 205 is welded to the fourth surface of the second structural plate 202 on the corresponding side; and/or the wave peak portion of the first plate 203 is connected to the second surface of the first structural plate 201 on the corresponding side through a first anchor rod, and the wave peak portion of the second plate 205 is connected to the fourth surface of the second structural plate 202 on the corresponding side through a second anchor rod.

In some possible implementation modes, the flexible energy dissipation component 2 further includes: a third plate, and a fourth plate arranged horizontally opposed to the third plate. The third plate and the fourth plate are horizontal plates. A third buffering energy dissipation space is formed between the third plate and the fourth plate. The space between the third plate and the fourth plate is filled with a third porous lightweight material. An outer wall of the third porous lightweight material is provided with a third buffering energy absorption channels communicated with an interior of the third porous lightweight material. When the third porous lightweight material is squeezed, gas inside the third buffering energy absorption channels is released. The third plate, the third porous lightweight material, and the fourth plate form an integrated third structural body.

This is because, in order to meet the needs of different installation portions, the third plate and the fourth plate of the flexible energy dissipation component 2 are arranged as horizontal plates.

In some possible implementation modes, the first structural body has a thickness size of 50 mm to 250 mm.

In specific implementation, the thickness size of the first structural body can be selected based on the size of a tunnel and installation requirements.

In some possible implementation modes, the first porous lightweight material 204 arranged between the first plate 203 and the second plate 205, and the second porous lightweight material arranged between the third plate and the fourth plate have a filling density of 250 kg/m$^3$ to 700 kg/m$^3$.

This density range can meet the pressure and deformation amount requirements of the buffer layer under different working conditions.

In some possible implementation modes, the porous lightweight material includes one of the following materials: foam concrete, ceramsite microsphere mixed lightweight soil, porous slag material, polyurethane foam, etc.

It needs to be noted that the above-mentioned materials have good fire resistance and are specially designed to quickly solidify and form after pouring.

In some possible implementation modes, the flexible energy dissipation component 2 is provided with multi-layered and arranged at an inverted arch position of the tunnel.

It needs to be noted that the flexible energy dissipation component can be arranged both in a single layer or multiple layers, and can be paved between an initial support and a surrounding rock as a buffer layer as needed, or between an initial support and a secondary lining as a buffer layer as needed, or can be arranged in a full cross-section or separately arranged at an arch ring, an inverted arch, and an arch foot as needed. For the flexible energy dissipation component arranged at different arrangement positions, the strength and the density of the porous lightweight material filled the inside thereof may be designed non uniformly; and when the flexible energy dissipation component is designed with multiple layers, the porous lightweight material filled inside thereof can be designed with equal density and strength, or designed according to a gradient In some possible implementation modes, a plurality of pouring holes is arranged in the first plate and the second structural body in a penetrating manner. Moreover, the pouring holes are plum blossom-shaped holes, which facilitate that a slurry flows through the plum blossom-shaped hole during pouring.

In summary, the present invention has the following advantages.

1. The porous lightweight soil filled corrugated sandwich plate, used as the underground engineering buffer layer support structure, can achieve fabricated construction of the buffer layer. By adjusting parameters such as the thickness of the corrugated sandwich plate, the density of the filling material, and the number of the buffer layer, the pressure and deformation amount requirement of the buffer layer can be met under different working conditions.
2. The porous lightweight soil filled corrugated sandwich plate can be applicable to a buffer support between the initial support and the surrounding rock. On the one hand, the pressure of the surrounding rock is more evenly transmitted to a steel arch and shotcrete through an energy absorption panel. On the other hand, due to the protection of the energy absorption panel, the safety of operating personnel can be improved.
3. The porous lightweight soil filled corrugated sandwich plate can be applicable to a buffer layer support between the initial support and the secondary lining layer. Paving is convenient, and a smooth contour is formed without any protrusions after installation, with a little impact on the paving of a waterproof layer.
4. The porous lightweight soil filled corrugated sandwich plate can be processed into a curved surface shape or a flat plate shape to meet the needs of different installation portions.
5. The porous lightweight soil filled corrugated sandwich plate is continuously arranged along the contour of the tunnel, and compared with discontinuous buffering energy absorption members, the lining structure is subjected to a more uniform stress.
6. A sine wave shaped wall of the porous lightweight soil filled corrugated sandwich plate makes a pressure more stable in a compression process compared with an ordinary straight wall.
7. According to the inherent characteristics of freeze protection, heat preservation, and vibration reduction of the porous lightweight materials, the present invention is helpful to achieve the integrated design aiming at solving large tunnel extrusion deformation, freeze damage, and seismic hazard.

Due to the fact that Embodiment II and Embodiment I are embodiments under the same inventive concept, and some of the structures thereof are completely identical, the structure in Embodiment II substantially identical to that in Embodiment I will not be elaborated in detail. For the parts that are not elaborated, please refer to Embodiment I.

Finally, it should be noted that the above embodiments are merely specific implementation modes of the present invention used for illustrating rather than limiting the technical solutions of the present invention. The protection scope of the present invention is not limited thereto. Although the present invention has been described in detail with reference to the above-mentioned embodiments, those of ordinary skill in the art should understand that any skilled in the art can still modify or easily think of changes to the technical solution described in the above-mentioned embodiment, or equivalently replace some of the technical features therein. These modifications, changes or replacements cannot cause the essence of corresponding technical solutions to depart from the scope of the technical solutions in the embodiments of the present invention, and should all be within the protection scope of the present invention. Therefore, the protection scope of the present invention shall be subject to the appended claims.

Although the implementation solutions of the present invention have been disclosed above, they are not limited to the applications listed in the description and implementation modes, and can be fully applied to various fields suitable for the present invention. For those skilled in the art, further modifications can be easily implemented. Therefore, without departing from the general concept defined by the claims and equivalent scope, the present invention is not limited to specific details and the illustrations shown and described herein.

The invention claimed is:

1. A fabricated underground engineering buffer layer support structure, comprising:

a first structural plate, comprising a first surface and a second surface, wherein the first structural plate is connected to an initial support layer through the first surface;

a second structural plate, comprising a third surface and a fourth surface, wherein the second structural plate is connected to a secondary lining layer through the fourth surface; a first buffering energy dissipation space is formed between the second surface and the third surface; and a flexible energy dissipation component arranged in the first buffering energy dissipation space, wherein the flexible energy dissipation component comprises a first plate prepared and formed by a plastic material, and a first porous lightweight material filled in the first buffering energy dissipation space and arranged on a periphery of the first plate in a wrapping manner; the first plate is of a wave shape; an outer wall of the first porous lightweight material is provided with first buffering energy absorption channels communicated with an interior of the first porous lightweight material, and when the first porous lightweight material is squeezed, gas inside the first porous lightweight material is squeezed and released through the first buffering energy absorption channels; and, the first structural plate, the flexible energy dissipation component, and the second structural plate form an integrated first structural body.

2. The fabricated underground engineering buffer layer support structure according to claim 1, wherein the buffering energy absorption component further comprises:

a second plate arranged parallel and opposite to the first plate; the second plate is of a wave shape; a second buffering energy dissipation space is formed between the second plate and the first plate, and the second buffering energy dissipation space is filled with a second porous lightweight material; an outer wall of the second porous lightweight material is provided with second buffering energy absorption channels communicated with an interior of the second porous lightweight material, and when the second porous lightweight material is squeezed, gas inside the second porous lightweight material is squeezed and released through the second buffering energy absorption channels; and, the first plate, the second porous lightweight material, and the second plate form an integrated second structural body.

3. The fabricated underground engineering buffer layer support structure according to claim 2, wherein the first plate and the second plate both are of a sine wave shape, wherein a wave peak portion of the sine wave shaped first plate is correspondingly connected to the second surface of the first structural plate on a corresponding side, and a wave peak portion of the sine wave shaped second plate is correspondingly connected to the fourth surface of the second structural plate on a corresponding side.

4. The fabricated underground engineering buffer layer support structure according to claim 3, wherein the wave peak portion of the sine wave shaped first plate is welded to the second surface of the first structural plate on the corresponding side, and the wave peak portion of the sine wave shaped second plate is welded to the fourth surface of the second structural plate on the corresponding side;

and/or the wave peak portion of the sine wave shaped first plate is connected to the second surface of the first structural plate on the corresponding side through a first anchor rod, and the wave peak portion of the sine wave shaped second plate is connected to the fourth surface of the second structural plate on the corresponding side through a second anchor rod.

5. The fabricated underground engineering buffer layer support structure according to claim 1, wherein the flexible energy dissipation component further comprises:

a third plate; and a fourth plate arranged horizontally opposed to the third plate, wherein the third plate and the fourth plate are horizontal plates, a third buffering energy dissipation space is formed between the third plate and the fourth plate, and the space between the third plate and the fourth plate is filled with a third porous lightweight material, an outer wall of the third porous lightweight material is provided with third buffering energy absorption channels communicated with an interior of the third porous lightweight material, and when the third porous lightweight material is squeezed, gas inside the third buffering energy absorption channels is released; and the third plate, the third porous lightweight material, and the fourth plate form an integrated third structural body.

6. The fabricated underground engineering buffer layer support structure according to claim 5, wherein a thickness size of the first structural body is 50 mm to 250 mm.

7. The fabricated underground engineering buffer layer support structure according to claim 6, wherein the first porous lightweight material arranged between the first plate and the second plate, and the second porous lightweight material arranged between the third plate and the fourth plate have a filling density of 250 $kg/m^3$ to 700 $kg/m^3$.

8. The fabricated underground engineering buffer layer support structure according to claim 7, wherein the porous lightweight material comprises one of the following materials:

foam concrete, ceramsite microsphere mixed lightweight soil, porous slag, and polyurethane foam.

9. The fabricated underground engineering buffer layer support structure according to claim 8, wherein the flexible energy dissipation component is able to be provided with multiple layers; wherein a strength and a density of the porous lightweight material filled inside the flexible energy dissipation component of the buffer layer support structure being arranged at different arrangement positions are able to be designed non-uniformly; and, when the flexible energy dissipation component is designed with the multiple layers, porous lightweight materials filled inside the flexible energy dissipation component of the multiple layers are designed with equal density and strength, or designed to have gradients in density and intensity.

10. The fabricated underground engineering buffer layer support structure according to claim 9, wherein a plurality of pouring holes is arranged in the first plate and the second structural body in a penetrating manner.

* * * * *